US011624272B2

(12) United States Patent
Kay

(10) Patent No.: US 11,624,272 B2
(45) Date of Patent: Apr. 11, 2023

(54) WELL PRODUCTION OPTIMIZATION USING HYPERSPECTRAL IMAGING

(71) Applicant: Husky Oil Operations Limited, Calgary (CA)

(72) Inventor: Anthony Kay, Calgary (CA)

(73) Assignee: Husky Oil Operations Limited, Calgary (CA)

( * ) Notice: Subject to any disclaimer, the term of this patent is extended or adjusted under 35 U.S.C. 154(b) by 0 days.

(21) Appl. No.: 17/674,738

(22) Filed: Feb. 17, 2022

(65) Prior Publication Data

US 2022/0170355 A1 Jun. 2, 2022

Related U.S. Application Data

(63) Continuation of application No. 16/808,260, filed on Mar. 3, 2020, now Pat. No. 11,448,053.

(60) Provisional application No. 62/813,813, filed on Mar. 5, 2019.

(51) Int. Cl.

| | |
|---|---|
| ***E21B 43/24*** | (2006.01) |
| ***E21B 49/08*** | (2006.01) |
| ***E21B 43/14*** | (2006.01) |

(52) U.S. Cl.

CPC ..... *E21B 43/2408* (2013.01); *E21B 43/14* (2013.01); *E21B 49/08* (2013.01); *E21B 49/0875* (2020.05)

(58) Field of Classification Search

CPC ..... E21B 43/2408; E21B 43/14; E21B 49/08; E21B 49/0875

See application file for complete search history.

(56) References Cited

U.S. PATENT DOCUMENTS

| | | | | |
|---|---|---|---|---|
| 9,309,756 | B1 * | 4/2016 | Affholter | E21B 43/24 |
| 9,334,729 | B2 | 5/2016 | Indo et al. | |
| 2007/0035736 | A1 | 2/2007 | Vannuffelen et al. | |
| 2010/0223011 | A1 | 9/2010 | Parsche | |
| 2014/0124194 | A1 | 5/2014 | Jorshari | |
| 2014/0345861 | A1 | 11/2014 | Stalder et al. | |
| 2018/0121706 | A1 | 5/2018 | Dante et al. | |
| 2020/0284131 | A1 | 9/2020 | Kay | |

FOREIGN PATENT DOCUMENTS

| | | | | |
|---|---|---|---|---|
| CA | 2757125 | A1 | 2/2013 | |
| CA | 2834980 | A1 * | 5/2014 | B01D 17/0214 |
| CA | 2834980 | A1 | 5/2014 | |

OTHER PUBLICATIONS

CA Office Action dated Jun. 30, 2021 of Application No. 3,073,881.

* cited by examiner

*Primary Examiner* — Crystal J. Lee

(74) *Attorney, Agent, or Firm* — Gordon & Jacobson, P.C.

(57) ABSTRACT

Methods and systems are provided for optimizing bitumen production from a plurality of wells employing steam-based recovery techniques such as SAGD, using hyperspectral imaging of produced emulsion samples to estimate total bitumen content at each well as a means of determining steam injection adjustment to enhance production.

26 Claims, 3 Drawing Sheets

WELL PRODUCTION OPTIMIZATION USING HYPERSPECTRAL IMAGING

CROSS-REFERENCE TO RELATED APPLICATION(S)

The present disclosure is a continuation of U.S. patent application Ser. No. 16/808,260, filed on Mar. 3, 2020, which claims priority from U.S. Provisional Patent Appl. No. 62/813,813, filed on Mar. 5, 2019, entitled "WELL PRODUCTION OPTIMIZATION USING HYPERSPECTRAL IMAGING," which are herein incorporated by reference in their entireties.

BACKGROUND

Field

The present disclosure relates to optimization of hydrocarbon production, and more specifically to optimization of production in steam-assisted gravity drainage operations.

Related Art

It is known in the art of hydrocarbon production from subsurface reservoirs that some types of hydrocarbon resource are not amenable to conventional recovery techniques. For example, higher-density hydrocarbons such as bitumen (which may be in the form of heavy oil or oil sands) cannot flow to surface under reservoir pressure conditions. In order to produce such heavy hydrocarbons, various methods have been proposed and implemented in order to mobilize the resource and produce it to surface.

A number of steam-based recovery techniques have been applied to access heavy hydrocarbon resources, in which steam (alone or in combination with other injectants such as solvents) is injected downhole into a reservoir to heat and/or dilute the hydrocarbon and thus render it amenable to flow and production to surface, such as for example cyclic steam stimulation (CSS). Another such method is referred to as steam-assisted gravity drainage (SAGD), in which two horizontal wells, an upper injector and a lower producer, are drilled into the reservoir; steam is injected into the reservoir through the injector well, which mobilizes the hydrocarbon so that it flows downwardly by gravity to the underlying producer well, and the mobilized hydrocarbon in an emulsion is then produced to surface through the producer well. Commonly, a plurality of SAGD well-pairs are drilled adjacent to each other in an area of interest, and steam is delivered to each injector well from a central facility.

It has been found, however, that different producer wells in an area will produce different percentages of hydrocarbon, such that some wells are more valuable than others in terms of their output at a given time. Various methods have been developed or are currently under development to optimize production from steam-based recovery operations by adjusting steam injection rates and providing increased steam injection to those wells with richer hydrocarbon production. One significant obstacle for these efforts is that conventional means for assessing the hydrocarbon being produced from a well can be time-consuming and expensive. For example, a conventional technique for estimating total bitumen content (TBC) in a produced emulsion is to conduct a Dean-Stark analysis of an emulsion sample, which can take approximately one day for a single sample from a single well, which does not provide the necessary information in a desirable time frame. Meters have also been proposed for monitoring bitumen production, but they are generally considered to provide poor accuracy and require constant calibration.

SUMMARY

The present disclosure solves these issues by estimating bitumen content (e.g., TBC) such that steam injection adjustment decisions can be made in a more timely manner. Specifically, the present disclosure provides methods and system for estimating bitumen content in produced emulsion, to enable steam supply adjustment to a plurality of injector wells.

According to a first broad aspect of the present invention, there is provided a method for optimizing production of hydrocarbon from a plurality of steam-assisted gravity drainage well-pairs, each well-pair comprising an injector well and a producer well, the method comprising:

injecting steam into a subsurface reservoir through the respective injector wells of the plurality of well-pairs;

allowing the injected steam to mobilize hydrocarbon in the reservoir and generate a producible emulsion;

producing the emulsion through the respective producer wells of the plurality of well-pairs;

obtaining a plurality of samples of the emulsions produced from the respective producer wells of the plurality of well-pairs;

measuring reflectance spectral data for each one of the plurality of samples;

estimating bitumen content for each one of the plurality of samples based on the reflectance spectral data; and adjusting steam injection through at least one injector well of the plurality of well-pairs based on the estimated bitumen content for each of the plurality of samples.

In some exemplary embodiments, the adjusting of steam injection through at least one injector well is configured such that the injector well for at least one well-pair with higher estimated bitumen content production receives increased steam volume in a subsequent steam injection. Such adjusting can involve sorting the plurality well-pairs based on the estimated bitumen content for the plurality of well-pairs.

In some exemplary embodiments, the emulsion is an oil-water emulsion and each one of the injector wells can be initially provided with the same volume of steam. Furthermore, each one of the plurality of well-pairs can originate at a corresponding surface-located well pad, and each one of the plurality of samples can be obtained at the well pad of the corresponding well-pair. The emulsion produced from at least one (or all) of the plurality of well-pairs can be piped to a central processing facility for mixing with the emulsion from the one or more other well-pairs after sampling.

In some exemplary embodiments, a total volume of steam is made available for injection into the respective injector wells of the plurality of well-pairs. In such cases, the step of adjusting the steam injection may comprise directing a larger percentage of the total volume of steam to the injector wells of well-pairs with the higher estimated bitumen content production in the subsequent steam injection.

In some exemplary embodiments, the operations of the method can be repeated one or more additional times in order to adjust steam injection into the respective injector wells of the plurality of well-pairs over time.

In some exemplary embodiments, the estimation of bitumen content for the respective samples can use a calibration model based on measurements of control samples. The measurements of the control samples can include Dean-Stark measurement of total bitumen content in each control sample and obtaining a reflectance spectra of each control sample. The Dean-Stark measurements and the reflectance spectra for the control samples may then be incorporated into the calibration model using Gaussian fitting and wavelet analysis.

In some exemplary embodiments, the reflectance spectral data can be measured using a spectrometer, such as an Analytical Spectral Device Fieldspec FR spectrometer or hyperspectral sensor.

In some exemplary embodiment, the injection rate of steam through the respective injector wells can be adjusted to adjust the injected volume of steam per unit time.

According to a second broad aspect of the present invention, there is provided a method for optimizing production of hydrocarbon from a plurality of steam-assisted gravity drainage well-pairs, each well-pair comprising an injector well and a producer well, the method comprising:

injecting steam at an injection rate into a subsurface reservoir through the respective injector wells of the plurality of well-pairs;

allowing the injected steam to mobilize hydrocarbon in the reservoir and generate a producible emulsion;

producing the emulsion through the respective producer wells of the plurality of well-pairs;

obtaining a plurality of samples of the emulsions produced from the respective producer wells of the plurality of well-pairs;

measuring reflectance spectral data for each one of the plurality of samples;

estimating bitumen content for each one of the plurality of samples based on the reflectance spectral data; and adjusting rate of steam injection through at least one injector well of the plurality of well-pairs based on the estimated bitumen content for each one of the plurality of samples.

In some exemplary embodiments, the adjusting of the rate of steam injection through the at least one injector well can be configured such that the injector well for at least one well-pair with higher estimated bitumen content production receive an increased steam injection rate in a subsequent steam injection. Such adjusting can involve sorting the plurality well-pairs based on the estimated bitumen content for the plurality of well-pairs.

In some exemplary embodiments, the emulsion is an oil-water emulsion and each one of the injector wells is initially provided with the steam at the same injection rate. Furthermore, each one of the plurality of well-pairs can originate at a corresponding surface-located well pad, and each one of the plurality of samples can be obtained at the well pad of the corresponding well-pair. The emulsion produced from at least one (or all) of the plurality of well-pairs can be piped to a central processing facility for mixing with the emulsion from the one or more other well-pairs after sampling.

In embodiments, the steam can be generated constantly and made available for injection through the respective injector wells. In such cases, the step of adjusting the steam injection rate may comprise increasing the steam injection rate to the well-pairs with the higher estimated bitumen content in the subsequent steam injection.

In some exemplary embodiments, the operations of the method can be repeated one or more additional times in order to adjust steam injection into the respective injector wells of the plurality of well-pairs over time.

In some exemplary embodiments, the estimation of bitumen content for the respective samples can use a calibration model based on measurements of control samples. The measurements of the control samples can include Dean-Stark measurement of total bitumen content in each control sample and obtaining a reflectance spectra of each control sample. The Dean-Stark measurements and the reflectance spectra for the control samples may then be incorporated into the calibration model using Gaussian fitting and wavelet analysis.

In some exemplary embodiments, the reflectance spectral data can be measured using a spectrometer, such as an Analytical Spectral Device Fieldspec FR spectrometer or hyperspectral sensor.

In some exemplary embodiment, the injection rate of steam through the respective injector wells can be adjusted to adjust the injected rate of steam per unit time.

A detailed description of an exemplary embodiment of the present invention is given in the following. It is to be understood, however, that the invention is not to be construed as being limited to this embodiment. The exemplary embodiment is directed to a particular application of the present invention, while it will be clear to those skilled in the art that the present invention has applicability beyond the exemplary embodiment set forth herein.

BRIEF DESCRIPTION OF THE DRAWINGS

In the accompanying drawings, which illustrate an exemplary embodiment of the present disclosure.

Exemplary embodiments of the present disclosure will now be described with reference to the accompanying drawings.

DETAILED DESCRIPTION OF EXEMPLARY EMBODIMENT

Throughout the following description specific details are set forth in order to provide a more thorough understanding to persons skilled in the art. However, well known elements may not have been shown or described in detail to avoid unnecessarily obscuring the disclosure. The following description is not intended to be exhaustive or to limit the invention to the precise form of any exemplary embodiment. Accordingly, the description and drawings are to be regarded and interpreted in an illustrative, rather than a restrictive, sense.

The exemplary embodiment of the present invention is directed to sampling of produced oil-water emulsion resulting from a plurality of SAGD well-pairs. A volume of steam is generated and divided among the injector wells of the plurality of well-pairs, with each injector well receiving a specific percentage of the steam. Initially, the same steam injection rate is applied to each injector well to reach a target operating pressure, but once a steam chamber is established for each well-pair the injection rate may be varied to optimize bitumen production as measured by steam/oil ratio (SOR). Emulsion is produced from each well-pair through the producer wells, and a sample of the emulsion is taken at each well pad. The TBC in each sample is estimated using hyperspectral reflectance, allowing for a determination as to which of the well-pairs are stronger bitumen producers. For those well-pairs determined to be stronger bitumen producers, it is advantageous to subsequently direct a larger percentage of the available steam to those well-pairs in order to enhance or optimize the overall bitumen production from the reservoir. While the volume of steam is varied in the exemplary embodiment, it will be clear to the skilled person that, in an alternative arrangement, steam could be constantly generated and the rate of injection to each injector well varied instead to adjust volume per unit time.

Figure 1:
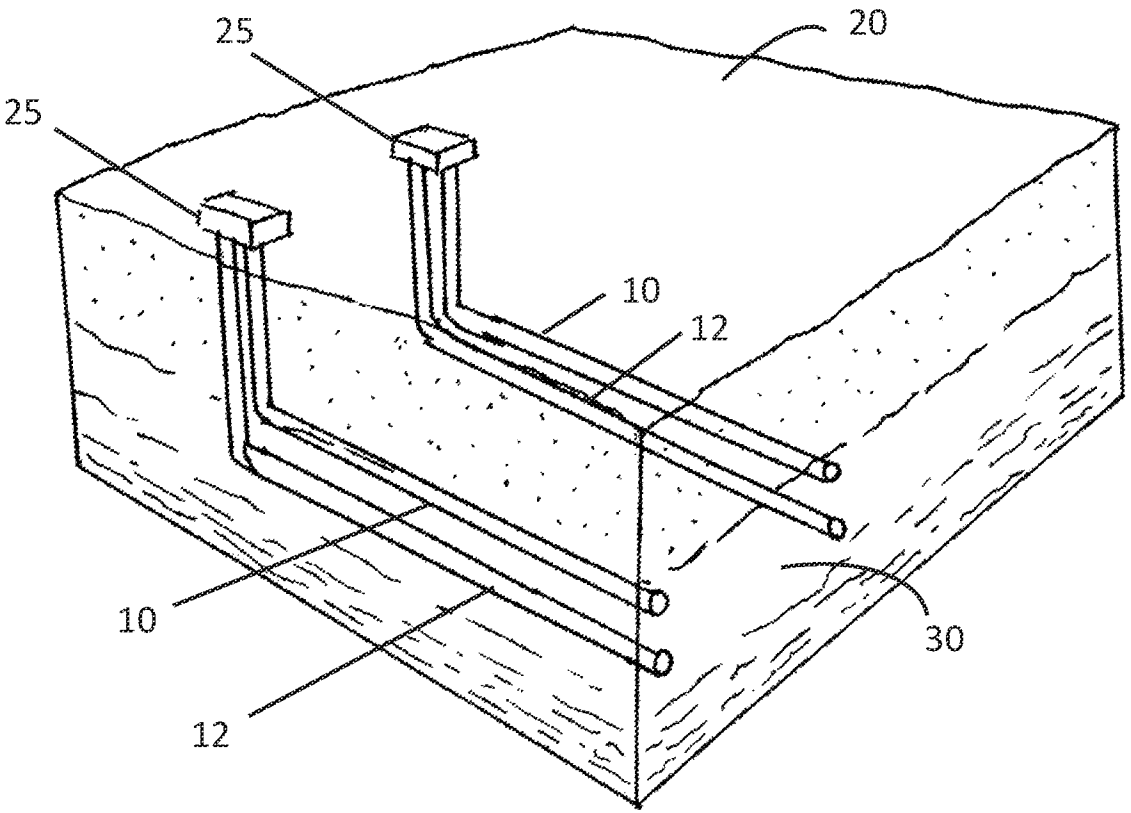
FIG. 1 is a schematic perspective view of a well system according to an embodiment of the present disclosure.

FIG. 1 illustrates an exemplary well system for producing hydrocarbons from a subsurface reservoir that contains bitumen (which can be in the form of heavy oil or oil sands). In this system, multiple well-pairs 10, 12 are drilled from the surface 20 into the subsurface formation 30, and an in situ SAGD thermal process is carried out in these wells-pairs to recover oil from the subsurface formation 30. The wells 10,12 of the multiple well pairs extend from the surface 20 downwards and then extend generally horizontally into and through the 30. The horizontal portions of the wells 10, 12 extend generally parallel to and spaced laterally from one another as shown. The method of drilling such wells are well known in the art and thus not described in detail here.

The well-pairs each include an injector well 10 and a producer well 12 that extend from a corresponding well pad 25 at the surface 20. The generally horizontal portion of the injector well 10 is disposed above and extends parallel to the generally horizontal portion producer well 12 of the pair. Although FIG. 1 shows two well-pairs, the well system of this embodiment can have any number of well pairs following this configuration.

The well configuration of each well pair 10, 12 corresponds to a conventional SAGD well-pair where the injector well 10 is used to inject steam into the surrounding formation in order to mobilize the bitumen. The mobilized bitumen flows into the producer well 12 for production to the corresponding well pad 25 at the surface 20.

Figure 2:
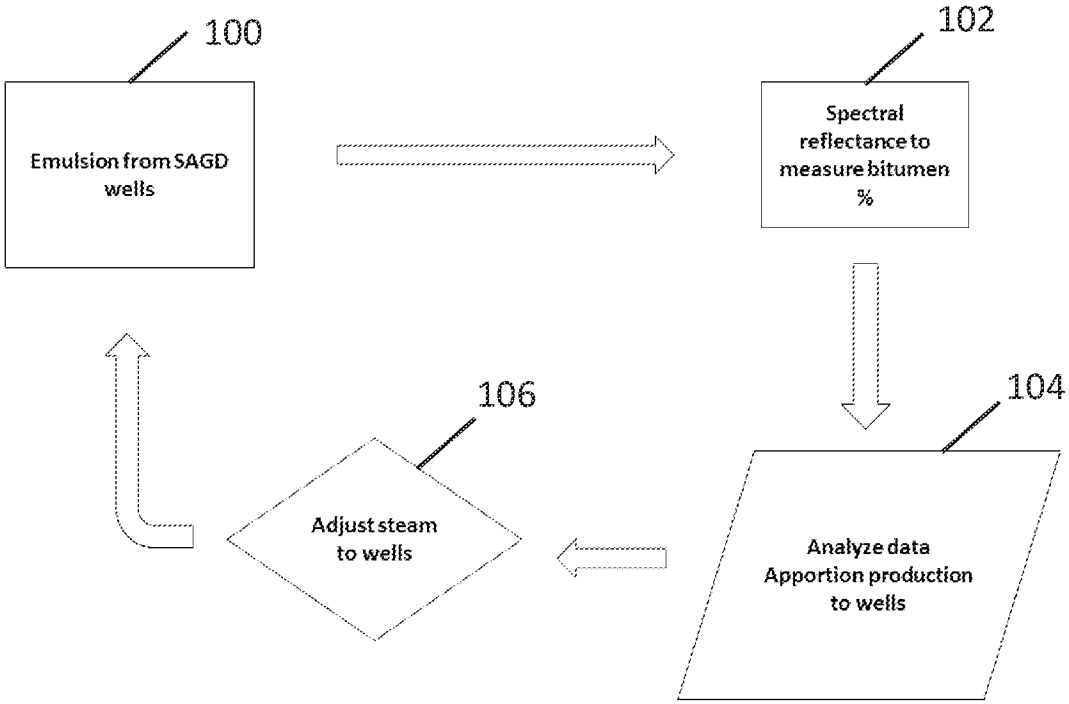
FIG. 2 is a flowchart illustrating how estimated TBC is used to adjust steam injection for subsequent injection activity in a continuous process.

FIG. 2 illustrates an exemplary embodiment of a method according to the present invention. As can be seen, the method establishes a loop in which hyperspectral reflectance data acquisition and data analysis provide a feedback mechanism for adjustment of steam to enable bitumen production optimization from a reservoir.

At step 100, an emulsion (e.g., water and oil) is produced from the production well of a SAGD well-pair, such as a production well 12 of FIG. 1. The produced emulsion will ultimately be piped to a central processing facility or CPF (not shown in FIG. 1) where emulsion from all of the well pads will be mixed together and distinguishing TBC values for the well-pairs would be lost. In this exemplary embodiment, a sample of the produced emulsion can be taken at each well pad (e.g., well pad 25 of FIG. 1) before the emulsion is sent to the CPF. Sampling means are well-known and commercially available, and the sample sizes produced using such sampling means are known in the art.

At step 102, hyperspectral reflectance measurements are performed on each one of the samples of produced emulsion, and the resulting data of the hyperspectral reflectance measurements is analyzed (processed) to determine estimates of bitumen content for the samples of produced emulsion. In embodiments, the estimate of bitumen content for a given sample of produced emulsion characterizes total bitumen concentration (TBC) of the sample. Various commercially-available systems and techniques are known for performing the hyperspectral reflectance measurements, and the sample sizes required will vary but are within the knowledge of the person skilled in the art. In embodiments, the hyperspectral reflectance signature of each sample of produced emulsion will be characterized by the bitumen absorption features that occur at specific wavelengths. In order to use hyperspectral reflectance values as representative of bitumen content (e.g., TBC), a calibration model can be established based on hyperspectral reflectance responses to fluid samples (referred to as "control samples") of known bitumen content. To this end, Dean-Stark measurements of TBC can be taken for a plurality of control samples having a range of TBC values providing a suitable hyperspectral reflectance range, for a non-limiting example 1-30 μm. This data can be incorporated into the calibration model using standard analysis techniques such as Gaussian fitting and wavelet analysis well-known to those skilled in the art. The calibration hyperspectral reflectance curves of the calibration model can be tested against a blind set of test samples for confirmation of accuracy.

To measure the hyperspectral reflectance data for each sample, a camera or spectrometer may be used to obtain the spectral response of the sample at specified wavelengths. For a non-limiting example, an Analytical Spectral Device Fieldspec FR spectrometer could be used, although other cameras and spectrometers such as hyperspectral sensors will be known to those skilled in the art as spectral reflectance is employed in drill core and oil froth analysis.

Once the hyperspectral reflectance data is obtained for a sample of produced emulsion, the data can be analyzed (processed) to determine an estimate of bitumen content (e.g., TBC) for the sample. In embodiments, the analysis (processing) can employ an algorithm to estimate the bitumen content (e.g., TBC) of the sample based on a set of calibration data from the Dean-Stark measurements correlated against the hyperspectral reflectance data. There are a number of appropriate mathematical approaches that would be known to those skilled in the art, such as for example wavelet or broadband. The bitumen content (e.g. TBC) of the sample can be used as an estimate for the bitumen contact (e.g., TBC) of the produced emulsion as a whole for the specific well-pair, and thus as an indication of the productive value of the specific well-pair.

At 104, the estimates of bitumen content (e.g., TBC) for the multiple well-pairs are collected, and the well-pairs can be ranked or otherwise sorted according to the varying bitumen content values. Where a well-pair is determined to produce a higher percentage of bitumen compared to other well-pairs, it can be selected for enhanced steam provision. In embodiments, the steam that is available for the well-pairs is thus apportioned based in part on this new data from the hyperspectral reflectance technique. For example, the injector well for one or more well-pairs determined to produce a higher percentage of bitumen can be configured to carry more steam (by volume) than the injector well for one or more other well-pairs, in order to produce more bitumen overall from the reservoir. In another example, the flow rate (rate) of steam that is injected through the injector well of one or more well-pairs determined to produce a higher percentage of bitumen can be increased such that it carriers more steam than the injector well for one or more other well-pairs, in order to produce more bitumen overall from the reservoir. In yet another example, the flow rate (rate) of steam that is injected through the injector well of one or more well-pairs determined to produce a lower percentage of bitumen can be decreased such that it carriers less steam than the injector well for one or more other well-pairs, in order to produce more bitumen overall from the reservoir.

At step 106, the adjusted steam volumes (or rates) as determined in 104 are applied to the well-pairs, and production can then continue under the adjusted steam regime, as shown in FIG. 2. In embodiments, the volume or rate of steam that is injected into the respective injector wells (e.g., wells 10 in FIG. 1) of the multiple well-pairs can be controlled by adjusting valves and/or pumps in the flow paths between one or more sources of the injection fluid (steam) and the respective injection wells. Furthermore, flow meters can be deployed to measure the flow rates of the steam injected through the respective injection wells. Injected steam volume for a given time period can be determined by integrating the measured flow rate over the given time period. The measurements performed by the flow meters can be used as inputs in controlling and adjusting the steam volume (or rates) applied to the well-pairs in step 106.

As will be clear from the above, embodiments of the present invention can include continuous monitoring of the well-pairs, and steam injection can even be automated using the feedback loop illustrated in FIG. 2.

Figure 3:
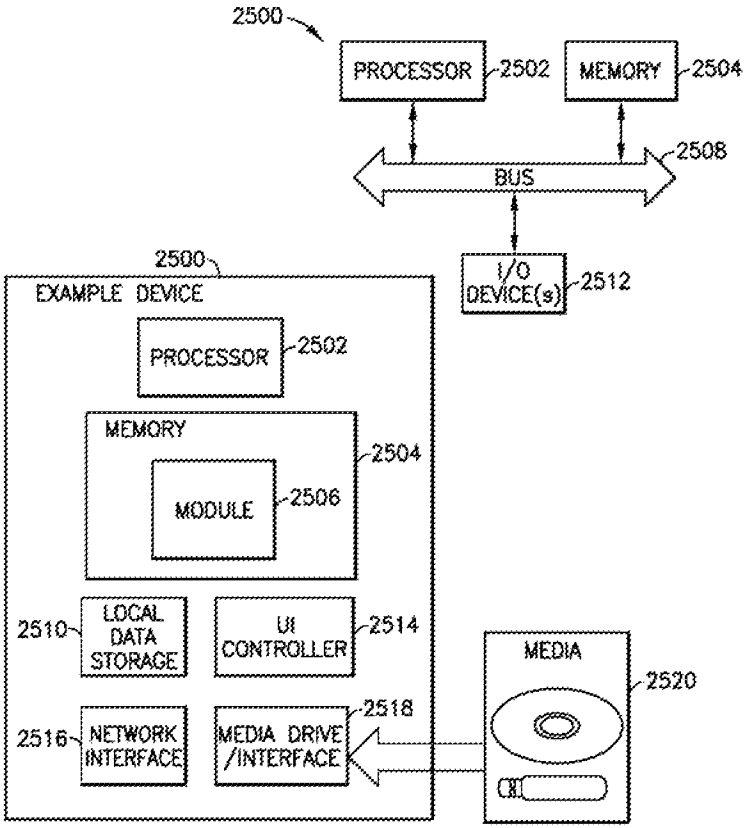
FIG. 3 is a schematic block diagram of an example computer system.

FIG. 3 illustrates an example device 2500, with a processor 2502 and memory 2504 that can be configured to implement various embodiments of the methods and systems described herein, such as estimating bitumen content (e.g., TBC) for the multiple well-pairs based on measured reflectance spectral data, ranking or otherwise sorting the multiple well pairs according to the varying bitumen content values, and controlling or adjusting the volume or rate of steam injection through the respective injector wells of the multiple well pairs as needed.

Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth).

One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network.

A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518. Various processes of the present disclosure or parts thereof can be implemented by instructions and/or software programs that are elements of module 2506. Such instructions and/or software programs may reside on removable media 2520 readable by media drive/interface 2518 as is well known in the computing arts.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various processes of the present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer. Some of the methods and processes described above, can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general-purpose computer) for executing any of the methods and processes described above.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to".

"connected", "coupled", or any variant thereof, means any connection or coupling, either direct or indirect, between two or more elements; the coupling or connection between the elements can be physical, logical, or a combination thereof.

"herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

The invention claimed is:

1. A method for optimizing production of hydrocarbon from a plurality of steam-assisted gravity drainage well-pairs, each well-pair comprising an injector well and a producer well, the method comprising the steps of:

a. injecting a volume of steam into a subsurface reservoir through each of the injector wells;

b. allowing the injected steam to mobilize hydrocarbon in the reservoir and generate a producible emulsion;

c. producing the emulsion to surface through the producer wells;

d. obtaining samples of the emulsion produced from each of the producer wells;

e. obtaining a reflectance spectra of each of the samples;

f. estimating a bitumen content for each of the samples based on the reflectance spectra; and g. adjusting steam injection to the injector wells such that well-pairs with higher estimated bitumen content receive increased steam volume in a subsequent steam injection;

wherein the step of adjusting the steam injection to the injector wells such that the well-pairs with higher estimated bitumen content receive the increased steam volume in the subsequent steam injection comprises sorting the well-pairs based on the estimated bitumen content.

2. The method of claim 1, wherein:

the emulsion is an oil-water emulsion.

3. The method of claim 1, wherein:

in step a, each of the injector wells is provided with the same volume of steam.

4. The method of claim 1, wherein:

each of the well-pairs originates at a well pad, and each of the samples is obtained at the well pad of the respective well-pair.

5. The method of claim 4, wherein:

the emulsion from one of the well-pairs is piped to a central processing facility for mixing with the emulsion from the other well-pairs after sampling at the well pad.

6. The method of claim 1, wherein:

a total volume of steam is made available for injection through the injector wells.

7. The method of claim 6, wherein:

the step of adjusting the steam injection comprises directing a larger percentage of the total volume of steam to the well-pairs with the higher estimated bitumen content in the subsequent steam injection.

8. The method of claim 1, wherein:

steps a. to g. are repeated at least once.

9. The method of claim 1, wherein:

the step of estimating the bitumen content for each of the samples based on the reflectance spectra comprises using a calibration model based on measurements of control samples.

10. The method of claim 9, wherein:

the measurements of the control samples comprises Dean-Stark measurements of total bitumen content in each of the control samples and obtaining a reflectance spectra of each of the control samples.

11. The method of claim 10, wherein:

the Dean-Stark measurements and the reflectance spectra for the control samples is incorporated into the calibration model using Gaussian fitting and wavelet analysis.

12. The method of claim 1, wherein:

the reflectance spectra is obtained using a camera or spectrometer.

13. The method of claim 12, wherein:

the camera or spectrometer is an Analytical Spectral Device Fieldspec FR spectrometer.

14. A method for optimizing production of hydrocarbon from a plurality of steam-assisted gravity drainage well-pairs, each well-pair comprising an injector well and a producer well, the method comprising the steps of:

a. injecting steam at a rate into a subsurface reservoir through each of the injector wells;

b. allowing the injected steam to mobilize hydrocarbon in the reservoir and generate a producible emulsion;

c. producing the emulsion to surface through the producer wells;

d. obtaining samples of the emulsion produced from each of the producer wells;

e. obtaining a reflectance spectra of each of the samples;

f. estimating a bitumen content for each of the samples based on the reflectance spectra; and g. adjusting steam injection rate to the injector wells such that well-pairs with higher estimated bitumen content receive steam at an increased rate in a subsequent steam injection;

wherein the step of adjusting the steam injection rate to the injector wells such that the well-pairs with higher estimated bitumen content receive steam at an increased rate in a subsequent steam injection comprises sorting the well-pairs based on the estimated bitumen content.

15. The method of claim 14, wherein:

the emulsion is an oil-water emulsion.

16. The method of claim 14, wherein:

in step a, each of the injector wells is provided with the steam at the same injection rate.

17. The method of claim 14, wherein:

each of the well-pairs originates at a well pad, and each of the samples is obtained at the well pad of the respective well-pair.

18. The method of claim 17, wherein:

the emulsion from one of the well-pairs is piped to a central processing facility for mixing with the emulsion from the other well-pairs after sampling at the well pad.

19. The method of claim 14, wherein:

the steam is constantly generated and made available for injection through the injector wells.

20. The method of claim 19, wherein:

the step of adjusting the steam injection rate comprises increasing the steam injection rate to the well-pairs with the higher estimated bitumen content in the subsequent steam injection.

21. The method of claim 14, wherein:

steps a. to g. are repeated at least once.

22. The method of claim 14, wherein:

the step of estimating the bitumen content for each of the samples based on the reflectance spectra comprises using a calibration model based on measurements of control samples.

23. The method of claim 22, wherein:

the measurements of the control samples comprises Dean-Stark measurements of total bitumen content in each of the control samples and obtaining a reflectance spectra of each of the control samples.

24. The method of claim 23, wherein:

the Dean-Stark measurements and the reflectance spectra for the control samples is incorporated into the calibration model using Gaussian fitting and wavelet analysis.

25. The method of claim 14, wherein:

the reflectance spectra is obtained using a camera or spectrometer.

26. The method of claim 25, wherein:

the camera or spectrometer is an Analytical Spectral Device Fieldspec FR spectrometer.

* * * * *